United States Patent [19]

Wissing

[11] Patent Number: 4,986,162

[45] Date of Patent: Jan. 22, 1991

[54] BLOCKING DEVICE TO INTERRUPT MOVEMENT OF A WEDGE-TYPE BREECHBLOCK

[75] Inventor: Gerd Wissing, Dusseldorf, Fed. Rep. of Germany

[73] Assignee: Rheinmetall, Düsseldorf, Fed. Rep. of Germany

[21] Appl. No.: 433,337

[22] Filed: Nov. 8, 1989

[30] Foreign Application Priority Data

Nov. 23, 1988 [DE] Fed. Rep. of Germany ..... 3839496

[51] Int. Cl.[5] ..... F41A 3/10

[52] U.S. Cl. ..... 89/24

[58] Field of Search ..... 89/24, 22, 4.2, 186; 42/23

[56] References Cited

U.S. PATENT DOCUMENTS

| | | | |
|---|---|---|---|
| 1,359,454 | 11/1920 | Adelman et al. | 89/4.2 |
| 1,651,128 | 11/1927 | Jervey | 89/24 |
| 2,613,576 | 10/1952 | Finn | 89/24 |
| 4,278,007 | 7/1981 | von Seidlitz | 89/24 |

FOREIGN PATENT DOCUMENTS

| | | | |
|---|---|---|---|
| 709411 | 8/1941 | Fed. Rep. of Germany | 89/4.2 |
| 2826739 | 6/1978 | Fed. Rep. of Germany | 89/24 |
| 1156407 | 10/1967 | United Kingdom . | |

*Primary Examiner*—Charles T. Jordan
*Assistant Examiner*—Stephen Johnson
*Attorney, Agent, or Firm*—Spencer & Frank

[57] ABSTRACT

A wedge-type breechblock arrangement for a gun having a breech-ring and being mounted on a gun cradle. The arrangement includes a breech wedge movable in the breech-ring transversely to the bore axis of the gun for opening and closing the breech end of the gun. A ramp is mounted on the cradle and a breech-opening shaft is connected with the breech wedge in the form-locking manner. A run-up lever is fixed to the breech-opening shaft and is in operative engagement with the ramp during an opening movement of the breech wedge. A holding device is provided for holding the breech wedge in an open position and for releasing the breech wedge to initiate movement to close the breech wedge. A blocking device is fixed to the cradle and includes a pivotally mounted blocking lever for pivoting into the path of movement of the run-up lever to block movement of the breech-opening shaft for limiting a first partial closing movement of the breech wedge.

10 Claims, 4 Drawing Sheets

BLOCKING DEVICE TO INTERRUPT MOVEMENT OF A WEDGE-TYPE BREECHBLOCK

CROSS REFERENCE TO RELATED APPLICATION

This application claims the priority of application Ser. No. P 38 39 496.0 filed Nov. 23, 1988, in the Federal Republic of Germany, the subject matter of which is incorporated herein by reference.

BACKGROUND OF THE DISCLOSURE

The present invention relates to a wedge-type breechblock arrangement in a gun having a breech-ring and being mounted on a gun cradle wherein the breech wedge is movable in the breech-ring transversely to the bore axis of the gun for opening and closing the breech end of the gun. In such an arrangement a ramp is mounted on the cradle and a breech-opening shaft is connected with the breech wedge in a form-locking manner. A run-up lever is fixed to the breech-opening shaft and is in operative engagement with the ramp during an opening movement of the breech wedge. A holding device is provided for holding the breech wedge in an open position and for releasing the breech wedge to initiate movement to close the breech wedge.

German Patent No. 2,826,739 and corresponding U.S. Pat. No. 4,278,007 disclose a wedge-type breech block of this type which is opened by actuation of a breech-opening shaft within the breech ring of a gun barrel transversely to the direction of the bore axis of a gun barrel.

It is known to have this opening process take place automatically during counterrecoil of the weapon by the interaction of a run-up lever with the ramp fixed to the cradle. It is further known for the breech wedge, when it is in the open position for loading the gun, to be held by the holding claws of a holding device disposed at the breech ring. In such weapons, after the holding claws have been pivoted out, the movement for closing the breech wedge is performed directly in one continuous stroke, for example, by means of a pneumatically charged breech wedge closing device. However, as a result of this continuous closing movement, the region of the breech wedge is a danger zone for the loading gunner. This results from the fact that when ammunition is introduced, the rear edge of the casing bottom actuates the holding claws to release the breech wedge. The breech wedge closing movement starts immediately after the actuation and may cause inadvertent damage to the gunner and/or the loading device disposed in the path of movement of the breech wedge.

SUMMARY OF THE INVENTION

It is an object of the present invention to improve the foregoing described wedge-type breechblock arrangement so that, in automatic operation, the loading device and particularly the loading tray and, if the ammunition is loaded manually, the loading gunner are protected.

The above and other objects are accomplished according to the invention by the provision, in the context of a wedge-type breechblock arrangement first described above, a blocking device fixed to the gun cradle and including a pivotally mounted blocking lever for pivoting into the path of movement of the run-up lever to block movement of the breech-opening shaft for limiting a first partial closing movement of the breech wedge.

The invention makes it possible in an advantageous manner, once the loading of the ammunition in the chamber is completed and the closing movement of the breech wedge has been actuated, to interrupt the closing movement of the breech wedge after a partial stroke until the loading device for the ammunition has been removed from the path of movement of the breech wedge. This provides for the safe supply of the ammunition, for example, onto a loading tray until it reaches an area immediately in front of the chamber of the gun barrel and to simply, as well as quickly, fix the ammunition supplied into the chamber. Possible damage to the loading device and dangers to operating personnel are avoided in that the breech wedge closing movement is not interrupted by the ammunition but by an externally controlled blocking device after a short closing stroke. The blocking device, according to the invention, simply intercepts the movement of the run-up lever of the breech-opening shaft. The arrangement of the blocking device is a rigid mounting in the gun cradle where it is not part of the recoiling masses. The arrangement, configuration and operation of the blocking device advantageously does not require any modifications, for example, in a prior art mass-produced breech ring and in the wedge-type breechblock. Such prior art weapon component groups manufactured in the past can therefore be easily retrofitted to realize a safe loading process.

BRIEF DESCRIPTION OF THE DRAWINGS

The invention will now be described in greater detail with reference to an embodiment that is illustrated in the drawings.

DETAILED DESCRIPTION OF THE PREFERRED EMBODIMENT

Figure 1:
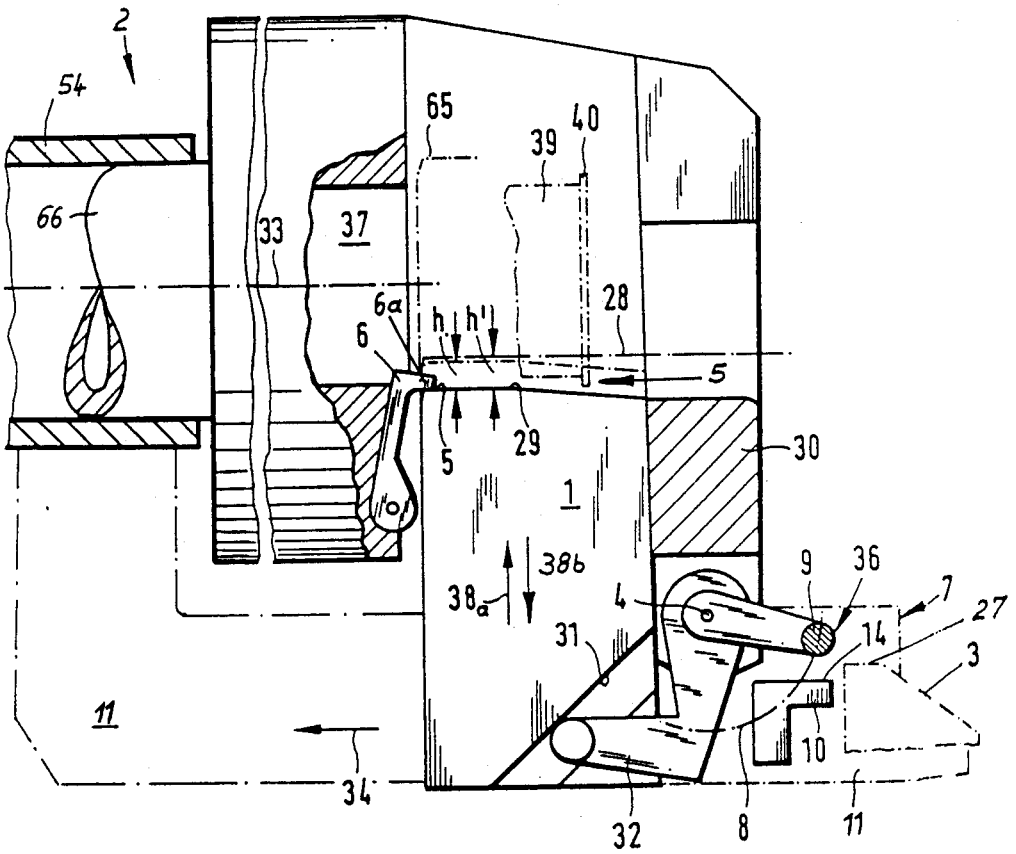
FIG. 1 is a partial, sectional side view of a wedge-type breechblock arrangement with a schematic representation of the blocking device according to the invention.

FIG. 1 shows the rear end of a gun 2 including a wedge-type breechblock or breech wedge 1 which can be moved in a breech ring 30 transversely to the bore axis 33 of the gun. Breech wedge 1 is opened by way of a breech-opening shaft 4 in that an opening lever 32 connected with shaft 4 engages in a sloped guide 31 of breech wedge 1. The opening of breech wedge 1 takes place in the direction of arrow **38*b* during the counterrecoil movement of the breech ring 30 which is connected with the gun barrel 66. A run-up lever 9 connected with breech-opening shaft 4 slides along a ramp 3 provided on the side of the cradle to initiate the opening of breech wedge 1 in a form-locking manner. Run-up lever 9 is here pivoted about breech-opening shaft 4 from a lower position 35 shown in FIG. 2 to the illustrated upper position 36**.

To retain breech wedge 1 in its open position 5 as shown in FIG. 1, a holding device 6 equipped with holding claws 6a is mounted in breech ring 30 laterally of chamber 37. The closing movement of breech wedge 1 in the direction of arrow 38a is initiated during the supplying of ammunition 39 (shown in phantom by the dash-dot lines in FIG. 1), with the edge of the ammunition casing bottom 40 releasing the locked position of holding device 6a. Due to the provision of, for example, a pneumatically charged wedge closer (not shown), breech wedge 1 leaves the open position 5 and then begins its closing movement in the direction arrow 38a.

Compared to this essentially known manner of actuation for opening and closing breech wedge 1, the present invention provides a solution of the problem described hereinabove in that the closing movement of breech wedge 1 is interrupted after a short closing stroke h which is slightly shorter than the distance h' existing between a loading tray 28 and upper side 29 of a completely open breech wedge 1. To achieve this partial closing movement h of breech wedge 1, a blocking device 7 is provided which is fixed to the gun cradle, preferably at a cradle tube (not shown). Blocking device 7 includes a blocking lever 10 that can be pivoted into the path of movement of run-up lever 9 of opening shaft 4 to block rotational movement of breech-opening shaft 4 which in turn limits movement of lever 32.

Figure 2:
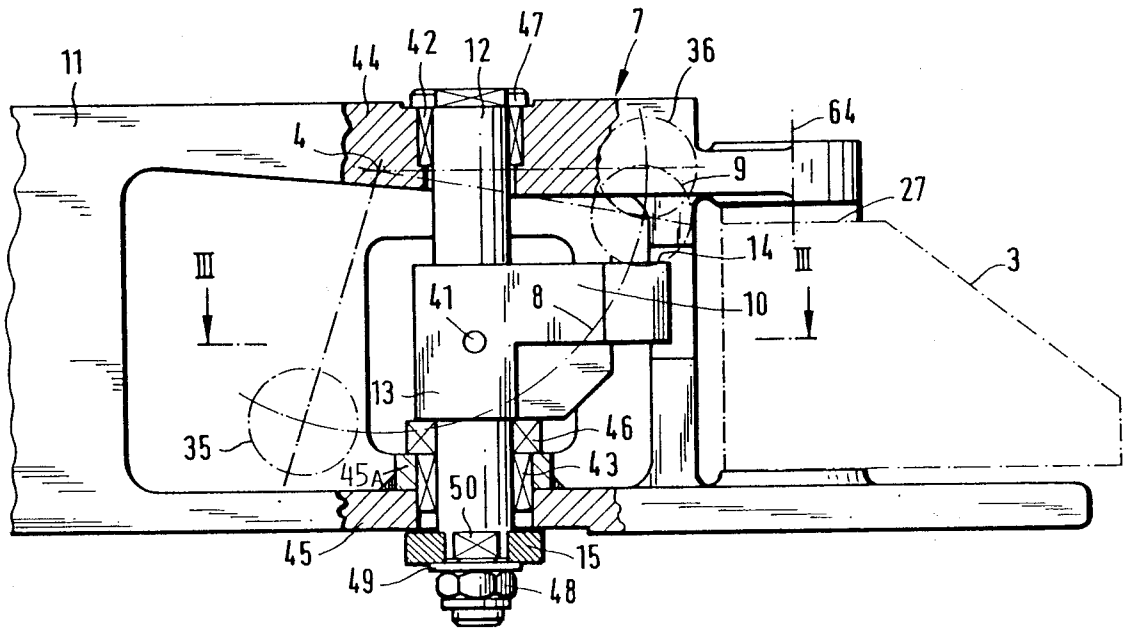
FIG. 2 is an enlarged view of the blocking device of FIG. 1.

Referring to FIG. 2, in order to be actuated, blocking lever 10 is form-lockingly connected with an actuating shaft 12 that is mounted in roller bearings 42, 43, 46 in the housing 11 of blocking device 7. Blocking lever 10 is driven by way of shaft 12 either manually or automatically by external energy. Blocking lever 10 includes a sleeve 13 surrounding shaft 12, with a pin 41 fixed to prevent rotation of sleeve 13 relative to shaft 12, thus forming a robust form-locking connection with shaft 12. Blocking lever 10 is configured as an angle lever with a frontal face 14 which extends in the radial direction of shaft 12 to serve as an abutment face in the axial direction relative to shaft 12 for run-up lever 9 so that force is transmitted in a stable manner during the process of interrupting run-up lever 9.

In order to realize the first partial stroke h of breech wedge 1, frontal face 14 of blocking lever 10 is offset relative to an upper end region 27 of ramp 3. At the end of the first partial stroke h of breech wedge 1, run-up lever 9 has thus partially traversed its path 8 around opening shaft 4 from a position 36 defined by ramp 3 up to the frontal face 14 of blocking lever 10.

To perform its pivoting movement, blocking lever 10 is disposed between two radial bearings 42, 43 surrounding shaft 12 and mounted in the respective housing wall 44, 45 of blocking device 7. In order to transfer the forces generated during the blocking process, blocking lever 10 is supported on one side by an axial pressure bearing 46 mounted on shaft 12 and supported at housing wall 45 by a ring 45a. For axial fixation, one end of shaft 12 is provided with a fixed head 47 and the other end with a nut 48 that can be screwed onto shaft 12.

Figure 3:
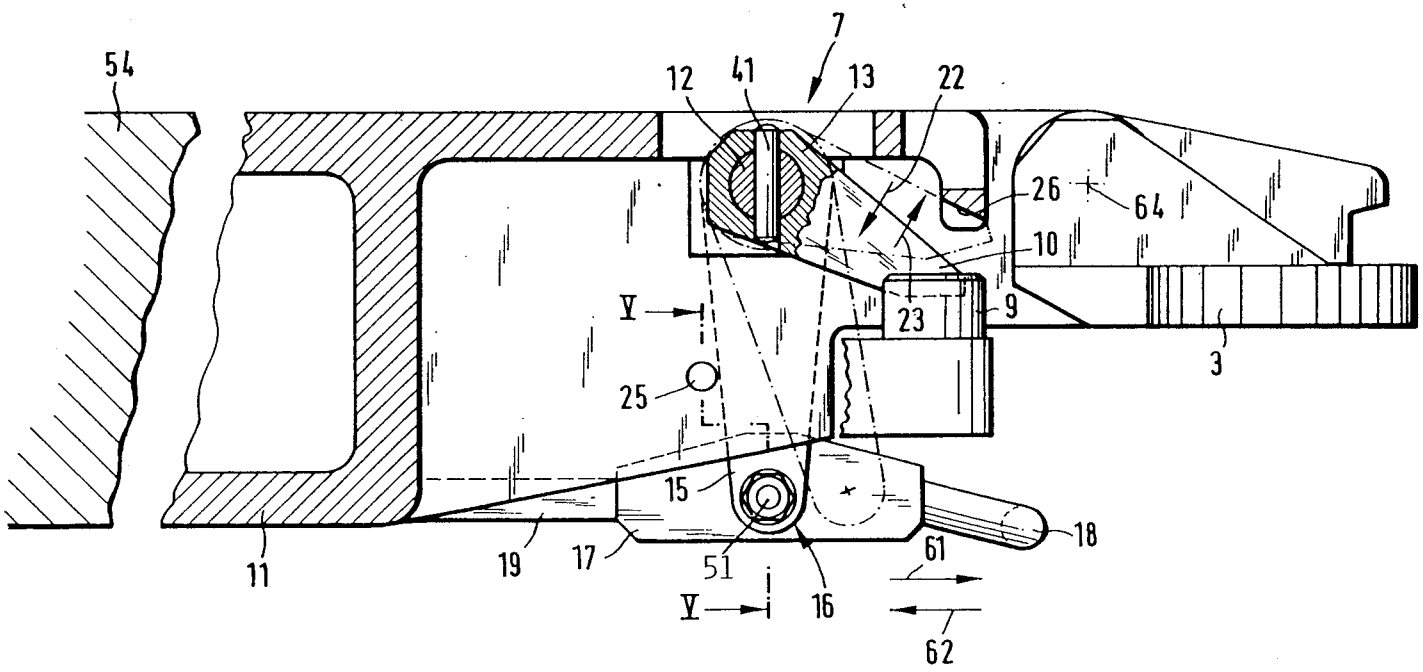
FIG. 3 is a sectional view of the blocking device along a line indicated by III—III in FIG. 2.

For actuation of blocking lever 10, shaft 12 is equipped with an actuating lever 15 in the form of an angle lever which is connected with shaft 12 in a form-locking manner. This actuating lever 15 is fastened on a multiple profile, for example a square profile 50 of shaft 12, between the exterior of housing wall 45 and a disk 49 preceding nut 48. As shown in FIG. 3, actuating lever 15 has an end 16 facing away from shaft 12, at which actuating lever 15 is connected by way of a nut and bolt connection 51, 52 (see FIG. 5) with a coupling member 17 which is equipped with a handle 18 in order to permit manual actuation and with a lifting rod 19 of a lifting device 20 (see FIG. 4) which can be automatically driven by external energy.

Lifting device 20 is releasably connected with housing 11 of blocking device 7 by means of a screw connection 53 and, together with blocking device 7, is connected, in a manner not shown, with the schematically illustrated cradle bearing 54 (FIG. 3).

Figure 4:
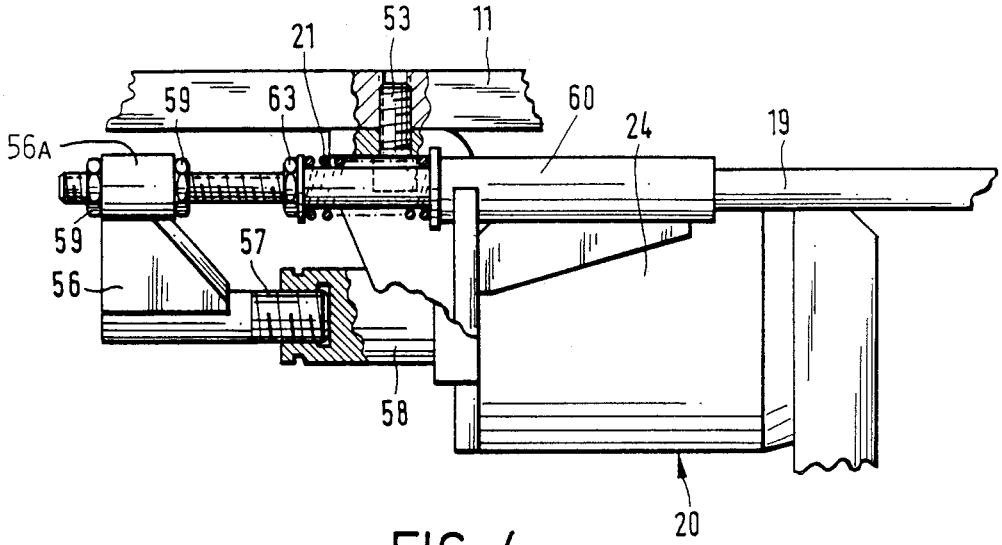
FIG. 4 is a side view of the drive assembly for the blocking device.
Figure 5:
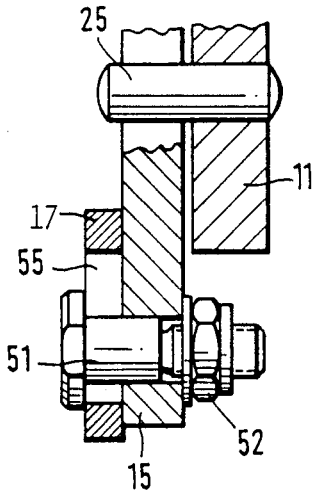
FIG. 5 is a sectional view along line V—V in FIG. 3 of a coupling member which connects the drive assembly and the blocking device with one another.

In order for blocking lever 10 to perform the blocking stroke relative to run-up lever 9 of breech-opening shaft 4 in the direction of arrow 22 (FIG. 3), a return spring 21 is coaxially mounted on lifting rod 19 as shown in FIG. 4 and, for the safety releasing stroke in the direction of arrow 23 (FIG. 3), there is provided a solenoid 24. In order for coupling rod 19 to perform a linear lifting movement, the receiving bore of bolt 51 of coupling member 17 is a long hole 55 (FIG. 5).

Referring to FIG. 4, a piston 58 of solenoid 24 is connected with a cross arm 56 by way of a thread 57. At its other end, cross arm 56 is equipped with a sleeve 56a having a bore to accommodate lifting rod 19 and is fastened to lifting rod 19 by means of nuts 59 disposed on both sides of sleeve 56a. Lifting rod 19 is mounted in a guide 60 of the housing of lifting device 20 to be displaceable in the direction of arrows 61, 62 (FIG. 3). While lifting device 20 moves lifting rod 19 into the direction of arrow 61 to permit blocking lever 10 to take on the unblocked position, compression spring 21 disposed coaxially at lifting rod 19 and supported on one side at guide 60 while being tensioned by way of a nut 63 takes care that blocking lever 10 takes on its blocking position in that spring 21 moves lifting rod 19 back in the direction of arrow 62. Lifting rod 19 moves in a plane parallel to the path of movement 8 (FIG. 2) of run-up lever 9. With reference to FIG. 3, blocking lever 10 is disposed on shaft 12 with an offset of more than 45° but less than 90° relative to angle lever 15 in order to realize a short stroke for blocking and unblocking run-up lever 9. The stroke of blocking lever 10 is limited by a pin 25 which is fastened to blocking device 7 and serves as a stop for actuating lever 15, while the safety releasing stroke of blocking lever 10 is directly limited by a stop 26 at the housing of blocking device 7.

As a whole, the following steps take place during each firing cycle in the wedge-type breechblock arrangement according to the invention. Breech ring 30 and run-up lever 9 connected thereto move back in the direction of arrow 61 under the influence of a shot. This causes run-up lever 9 to pivot ramp 3 which is disposed in an axis 64 in housing 11 to move out of the range of movement of run-up lever 9, while immediately thereafter a return spring (not shown) reestablishes the position of ramp 3 shown in FIG. 3.

During counterrecoil, breech ring 30 and run-up lever 9 move in the direction opposite to arrow 34 shown in FIG. 1 in which case run-up lever 9 is pivoted upwardly by ramp 3 around breech-opening shaft 4 until it reaches its end position 36 and breech wedge 1 takes on its maximum open position 5. Holding claws 6a of holding device 6 then retain breech wedge 1 until a round of ammunition 39, disposed in the ramming position on loading tray 28 immediately behind chamber 37, is transported into chamber 37 by means of a rammer (not shown). Due to the interrupted position of run-up lever 9 caused by blocking lever 10 which is forced into the blocking position underneath run-up lever 9 as shown in FIG. 2, the breech wedge closing stroke in the direction of arrow 38a (FIG. 1) initiated by the supply of ammunition is interrupted after a partial stroke h. During this interruption of the movement of breech wedge 1, loading tray 28 of the loading device (not shown in detail) can now be removed without danger from the path of movement of breech wedge 1. Then, in the manner described above, blocking lever 10 is moved, either automatically or manually, from a position underneath run-up lever 9 to a position against stop 26, thus releasing run-up lever 9 and permitting breech wedge 1 to perform the remainder of its closing stroke until it reaches a marker 65 (FIG. 1).

Obviously, numerous and additional modifications and variations of the present invention are possible in light of the above teachings. It is therefore to be understood that within the scope of the appended claims, the invention may be practiced otherwise than as specifically claimed.

What is claimed is:

1. A wedge-type breechblock arrangement for a gun having a bore axis and a breech end provided with a breech-ring, the gun being mounted on a gun cradle and comprising:

a breech wedge movable in the breech-ring transversely to the bore axis of the gun for opening and closing the breech end of the gun;

a ramp mounted on the cradle;

a breech-opening shaft connected with said breech wedge in a form-locking manner;

a run-up lever fixed to said breech-opening shaft and in operative engagement with said ramp during an opening movement of said breech wedge;

holding means for holding said breech wedge in an open position and for releasing said breech wedge to initiate movement to closed said breech wedge; and blocking means fixed to the cradle and including a pivotally mounted blocking lever for pivoting into the path of movement of said run-up lever to block movement of said breech-opening shaft for limiting a first partial closing movement of said breech wedge.

2. A wedge-type breechblock arrangement as defined in claim 1, wherein said blocking means includes: a housing; and an actuating shaft mounted in said housing, said blocking lever having a form-locking connection with said actuating shaft; and such arrangement further includes means connected to said actuating shaft for manually driving said actuating shaft; and means connected to said actuating shaft and mounted to said housing for automatically driving said actuating shaft by way of external energy.

3. A wedge-type breechblock as defined in claim 2, wherein said blocking lever includes a sleeve surrounding said actuating shaft and means securing said sleeve against rotation relative to said actuating shaft in order to realize said form-locking connection.

4. A wedge-type breechblock as defined in claim 1, wherein said blocking lever comprises an angle lever having one frontal face extending in the radial direction of said shaft to form an abutment face to block said run-up lever.

5. A wedge-type breechblock as defined in claim 4, wherein said ramp has an uppermost end region and the frontal face of said blocking lever is offset relative to the uppermost end region of said ramp in order to realize the first partial closing movement of said breech wedge.

6. A wedge-type breechblock as defined in claim 2, and further including: an actuating lever formed as an angle lever connected with said actuating shaft in a form-locking manner; and coupling means connected to an end of said actuating lever remote from said actuating shaft and arranged for linear movement either manually or automatically by way of the external energy.

7. A wedge-type breechblock as defined in claim 6, wherein said coupling means includes a handle to facilitate manual movement.

8. A wedge-type breechblock as defined in claim 6, and further including lifting means including a lifting rod connected to said coupling means and connected to an external energy source for driving said coupling means.

9. A wedge-type breechblock as defined in claim 8, wherein said lifting means includes: a return spring operatively connected with said lifting rod for urging said lifting rod in one direction so that said blocking lever performs a blocking stroke relative to said run-up lever; and a solenoid having a plunger connected to said lifting rod for moving said lifting rod in a direction opposite to said one direction for causing said blocking lever to perform a safety releasing stroke releasing said run-up lever and allowing said breech-opening shaft to complete the closing movement of said breech wedge.

10. A wedge-type breechblock as defined in claim 9, and further including: a pin fastened to said housing in a location to form an abutment for said actuating lever for limiting the blocking stroke of said blocking lever; and a further abutment defined by a portion of said housing for directly limiting the safety releasing stroke of said blocking lever.

* * * * *